US009108225B2

(12) United States Patent
Cartal et al.

(10) Patent No.: US 9,108,225 B2
(45) Date of Patent: Aug. 18, 2015

(54) MACHINE FOR SORTING "FLATS" AND LETTERS

(75) Inventors: Bruno Cartal, Montelier (FR); Pierre Jourdan, Valence (FR); Jean Rieu, Saint Georges les Bains (FR)

(73) Assignee: SOLYSTIC, Gentilly Cedex (FR)

( * ) Notice: Subject to any disclaimer, the term of this patent is extended or adjusted under 35 U.S.C. 154(b) by 432 days.

(21) Appl. No.: 12/678,079

(22) PCT Filed: Dec. 8, 2009

(86) PCT No.: PCT/FR2009/052435

§ 371 (c)(1),
(2), (4) Date: Mar. 12, 2010

(87) PCT Pub. No.: WO2010/072935

PCT Pub. Date: Jul. 1, 2010

(65) Prior Publication Data

US 2011/0180462 A1 Jul. 28, 2011

(30) Foreign Application Priority Data

Dec. 23, 2008 (FR) ..... 08 59045

(51) Int. Cl.
*B07C 3/08* (2006.01)

(52) U.S. Cl.
CPC ..... *B07C 3/08* (2013.01)

(58) Field of Classification Search
USPC ..... 209/509, 583, 584
IPC ..... B07C 3/08
See application file for complete search history.

(56) References Cited

U.S. PATENT DOCUMENTS

| | | | | | |
|---|---|---|---|---|---|
| 1,465,773 | A | * | 8/1923 | Wittum | 198/352 |
| 2,696,913 | A | * | 12/1954 | Anderson | 209/169 |
| 2,696,919 | A | * | 12/1954 | Gourdon | 414/286 |
| 2,751,092 | A | * | 6/1956 | Gourdon | 198/352 |
| 3,609,694 | A | * | 9/1971 | Brenner et al. | 700/227 |
| 4,507,739 | A | * | 3/1985 | Haruki et al. | 700/224 |
| 4,678,390 | A | * | 7/1987 | Bonneton et al. | 414/282 |
| 5,385,246 | A | * | 1/1995 | Grossnickle | 211/22 |
| 5,709,525 | A | * | 1/1998 | Marzullo et al. | 414/798.7 |

(Continued)

FOREIGN PATENT DOCUMENTS

| | | |
|---|---|---|
| EP | 1 726 371 A1 | 11/2006 |
| FR | 2 866 251 A1 | 8/2005 |

(Continued)

*Primary Examiner* — Stefanos Karmis
*Assistant Examiner* — Michael E Butler
(74) *Attorney, Agent, or Firm* — Sughrue Mion, PLLC

(57) ABSTRACT

A sorting machine for sorting mailpieces including both letters and flats comprises: a first sorting system (20) adapted for flats and including a first mailpiece conveyor suitable for directing the flats towards sorting outlets of the type having racks (26) into which the flats fall by gravity; and a second sorting system (1) adapted for letters and including a second mailpiece conveyor suitable for directing the letters towards sorting outlets of the type having stackers (7) in which the letters are stacked on edge one behind another. The two sorting systems have the same number of sorting outlets, the two systems being superposed so that the sorting outlets of the first sorting system are superposed on respective ones of the sorting outlets of the second sorting system. Each sorting outlet of the first system may be equipped with at least two racks towards each of which a flat can be directed selectively by the first conveyor.

7 Claims, 3 Drawing Sheets

(56) References Cited

U.S. PATENT DOCUMENTS

| | | | | |
|---|---|---|---|---|
| 5,718,321 | A * | 2/1998 | Brugger et al. | 198/359 |
| 6,183,191 | B1 * | 2/2001 | Mondie et al. | 414/807 |
| 6,239,397 | B1 | 5/2001 | Rosenbaum et al. | |
| 6,303,889 | B1 * | 10/2001 | Hayduchok et al. | 209/584 |
| 6,390,756 | B1 * | 5/2002 | Isaacs et al. | 414/281 |
| 6,501,041 | B1 * | 12/2002 | Burns et al. | 209/584 |
| 7,080,739 | B2 * | 7/2006 | Guy et al. | 209/630 |
| 7,156,220 | B2 * | 1/2007 | Olson et al. | 198/465.1 |
| 8,013,267 | B2 * | 9/2011 | Stemmle | 209/584 |
| 8,217,294 | B2 * | 7/2012 | Zimmermann | 209/584 |
| 8,230,141 | B2 * | 7/2012 | Zimmermann | 710/53 |
| 8,393,475 | B2 * | 3/2013 | Hugues et al. | 209/630 |
| 2003/0038055 | A1 * | 2/2003 | Ours et al. | 206/597 |
| 2003/0038065 | A1 * | 2/2003 | Pippin et al. | 209/584 |
| 2003/0209473 | A1 * | 11/2003 | Brinkley et al. | 209/547 |
| 2003/0226789 | A1 * | 12/2003 | Shiibashi et al. | 209/584 |
| 2004/0063197 | A1 * | 4/2004 | Tilles et al. | 435/287.2 |
| 2004/0159592 | A1 * | 8/2004 | McLaughlin et al. | 209/584 |
| 2005/0216118 | A1 * | 9/2005 | Conard et al. | 700/223 |
| 2005/0224399 | A1 * | 10/2005 | Forella et al. | 209/584 |
| 2005/0252836 | A1 * | 11/2005 | Burns et al. | 209/609 |
| 2005/0279674 | A1 | 12/2005 | Gillet | |
| 2006/0253406 | A1 * | 11/2006 | Caillon | 705/410 |
| 2007/0056885 | A1 * | 3/2007 | Enenkel et al. | 209/584 |
| 2007/0209976 | A1 * | 9/2007 | Worth et al. | 209/584 |
| 2009/0084845 | A1 * | 4/2009 | Post | 235/385 |
| 2010/0122942 | A1 * | 5/2010 | Harres et al. | 209/584 |
| 2010/0219142 | A1 * | 9/2010 | Chifflet et al. | 211/80 |
| 2011/0029127 | A1 * | 2/2011 | Stemmle | 700/223 |
| 2011/0192770 | A1 * | 8/2011 | Goertz et al. | 209/592 |

FOREIGN PATENT DOCUMENTS

| | | | |
|---|---|---|---|
| FR | 2 886 872 | A1 | 12/2006 |
| WO | 2009/072890 | A1 | 6/2009 |

* cited by examiner

MACHINE FOR SORTING "FLATS" AND LETTERS

CROSS REFERENCE TO RELATED APPLICATIONS

This application is a National Stage of International Application No. PCT/FR2009/052435 filed Dec. 8, 2009, claiming priority based on French Patent Application No. 0859045 filed Dec. 23, 2008 the contents of all of which are incorporated herein by reference in their entirety.

The invention relates to a postal sorting machine suitable for sorting both large-format articles or "flats", and also letters.

In the postal field, mailpieces are categorized into various different types as a function of their dimensions (height, length, and thickness) and of their weights. The different categories of mailpiece are defined in the ISO-269 Standard. For example, an envelope that can contain an A4-format or an A5-format sheet is a letter respectively having a C4 or a C5 format. A C4-format envelope has a width of 229 millimeters (mm) and a height of 324 mm. A C5-format envelope has a height of 162 mm and a width of 229 mm.

Currently, the spectrum of mailpieces that can be sorted automatically by machines covers mainly: from letters to other flat articles up to the C5 format that are of thickness less than 8 mm and of weight no greater than 100 grams (g); and large-format flat articles or "flats" that can be even larger than letters of C4 format and above and of thickness that can be up to 32 mm and of weight than can be up to 2 kilograms (kg). Above those dimensions, mailpieces cannot be sorted automatically.

In general, nowadays, there exist both postal sorting machines that are dedicated to respective ones of those two types of mailpieces, namely letters or flats, and also postal sorting machines that are capable of processing both letters and flats.

Such a postal sorting machine conventionally comprises a feed inlet with an unstacker for putting the mailpieces into series and on edge, an image acquisition system for automatically reading delivery addresses on the surfaces of the mailpieces, and a conveyor that directs the mailpieces towards sorting outlets as a function of the addresses that are read. A postal sorting machine that is dedicated to letters has sorting outlets of the "stacker" type in which the letters are stacked on edge in a certain longitudinal direction one behind another to form a stack. A postal sorting machine that is dedicated to flats has a conveyor of the bin carrousel type and sorting outlets in the form of racks into which the flats fall by gravity. The conveyor can also be a belt conveyor on which the flats are moved as laid flat. Routing flaps are provided along the conveyor to divert the flats towards the racks.

The increasing numbers of such specific machines that are dedicated to letters or to flats are necessarily giving rise to increasing overall costs related to acquiring the machines, storing them, and maintaining them.

Postal sorting machines capable of sorting a plurality of types of mailpieces suffer from the drawback of having low throughput rates that are generally insufficient in view of the requirements of postal sorting centers. In addition, such sorting machines are of complex construction and have high acquisition and maintenance costs.

Document U.S. Pat. No. 6,239,397 discloses a method of sorting both letters and flats by using two sorting machines dedicated respectively to letters and to flats. For preparing a delivery round or "postman's walk" using that method, the flats are subjected to a sorting pass in a first machine that is specialized for that type of article, and the delivery addresses read off those articles are transcribed onto separator cards forming substitutes for them. Letters and those substitutes are then subjected to a sorting pass in a second machine that is specialized for letters. Each substitute is then replaced manually by a respective flat in the stack of letters in order to prepare the delivery round. With that method, it is still not possible to achieve a throughput rate for processing the mailpieces that is compatible with the requirements of postal sorting centers.

An object of the invention is thus to propose a sorting machine for sorting mailpieces comprising both letters and flats that offers performance that is improved compared with the performance offered by current sorting machines.

To this end, the invention provides a sorting machine for sorting mailpieces including both letters and flats, which sorting machine is characterized in that it comprises:

- a first sorting system adapted for flats and including a first mailpiece conveyor suitable for directing the flats towards sorting outlets of the type having racks into which the flats fall by gravity; and
- a second sorting system adapted for letters and including a second mailpiece conveyor suitable for directing the letters towards sorting outlets of the type having stackers in which the letters are stacked on edge one behind another;

and in that the two sorting systems have the same number of sorting outlets, the two systems being superposed so that the sorting outlets of the first sorting system are superposed on respective ones of the sorting outlets of the second sorting system. According to the invention, each sorting outlet of the first system may be equipped with at least two racks towards each of which a flat can be directed selectively by the first conveyor.

In a particular embodiment of the invention, the two racks of a sorting outlet of the first sorting system are juxtaposed, and the conveyor of the first sorting system is a bin carrousel. In another particular embodiment of the invention, the two racks of a sorting outlet of the first sorting system are superposed, and the conveyor of the first sorting system is a belt conveyor on which the flats are moved as laid flat.

The sorting machine of the invention may have the feature that said racks of the sorting outlets of the sorting system for sorting the flats are offset depthwise relative to the stackers of the sorting outlets of the second sorting system for sorting letters, and the racks are mounted on runners.

The invention also provides a method of sorting mailpieces including both letters and flats by means of such a machine, which method comprises the following steps:

- passing the letters through the second sorting system for automatically sorting them into the sorting outlet stackers;
- passing the flats through the first sorting system for automatically sorting them into the sorting outlet racks; and
- merging one or more flats stored in a sorting outlet rack of the first sorting system manually with the letter(s) stored in the sorting outlet stacker of the second sorting system that is disposed in superposition with said sorting outlet rack.

In this method, it is advantageously possible to use the fact that the letters can have different dimensions, e.g. if consideration is given to letters of the C5 format and to letters of a format up to the C4 format, for example. In which case, during the sorting passes for sorting the letters, it is possible, for example, to pass the letters of C4 format first and then to pass the letters of C5 format, thereby making it possible, in the stackers, to have letters of the C4 format in front of the letters of the C5 format. This grouping together of letters of different formats can simplify the merging process. According to the invention, the sorting outlets are used as grouped together into a plurality of disjoint segments, and two racks of each sorting outlet of the first sorting system are used in alternation for merging the flats with the letters. This contributes to increasing the operational throughput rate of the sorting machine of the invention. It is possible to use a separator card to separate, in the same stacker, the letters that belong to different sorting outlet segments, thereby also simplifying the process of merging the flats with the letters.

The invention can be understood more clearly on reading the following description with reference to the accompanying drawings. This description is given merely by way of indication, and is in no way limiting on the invention. In the drawings.

Figure 1:
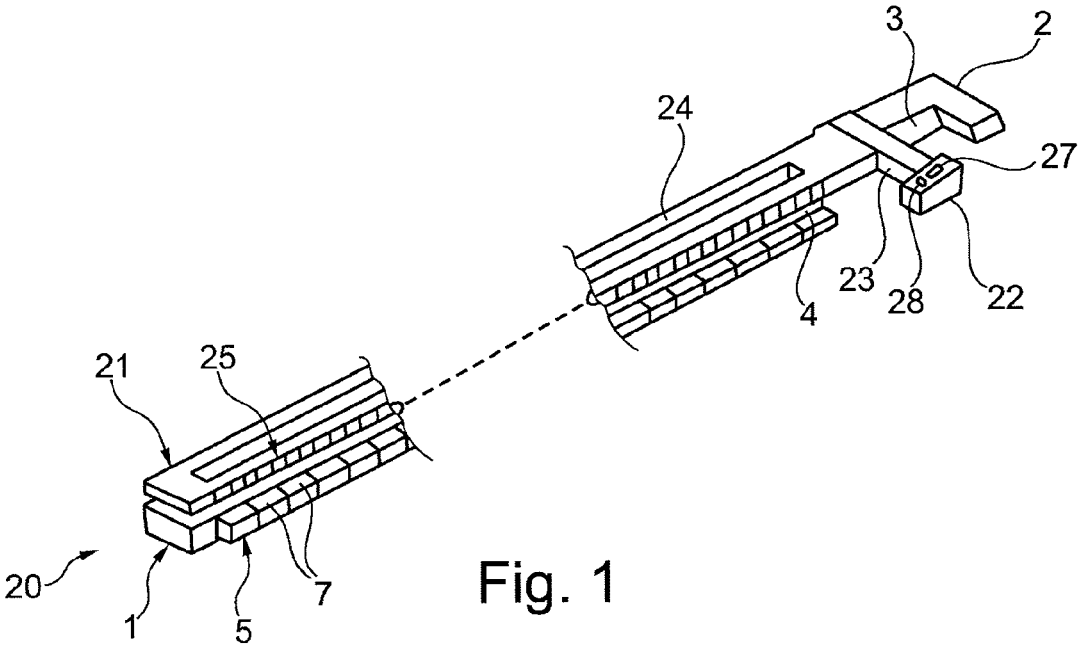
FIG. 1 is a highly diagrammatic view showing a sorting machine of the invention with the two superposed sorting systems.

FIG. 1 shows a postal sorting machine 20 of the invention that comprises, in superposition, a sorting system 1 adapted to sorting letters and a sorting system 21 adapted to sorting flats. In the invention, the term "letters" is used to mean envelopes of the C5 format and also envelopes of a larger format such as the C4 format, for example. The terms "large-format articles" and "flats" are used to mean articles of weight that can be in excess of the conventional limit of 2 kg.

The sorting system 1 comprises a feed inlet with an unstacker 2 for putting the letters into series, an acquisition system 3 for automatically reading a delivery address from each letter, and a belt conveyor 4 that moves the letters on edge towards sorting outlets 5 having stackers 7. In each stacker, the letters are stacked on edge one behind another to form a stack. The stack of letters is held by a movable paddle 8 (shown in FIG. 2) that can be raised to allow the letters to be extracted from the stacker. Storage trays 9 are disposed in retracted manner under the stackers 7. Said trays serve to transport the letters from the sorting outlets 5 towards the feed inlet of the sorting system 1 in particular between two successive sorting passes. Since the letters can have different formats, such as C5 and C4, the stackers 7 of the sorting outlets 5 are equipped with deflectors defining a baffle path at the tops for the purpose of guiding the tops of the letters of format C4 that tend to flop. Such stackers are described more particularly in Patent Document EP 08/164 808.

In FIG. 1, the letters sorting system 1 is disposed under the flats sorting system 21.

The sorting system 21 also comprises a feed inlet equipped with an unstacker 22 for putting the flats into series, an acquisition system 23 for automatically reading delivery addresses from the flats, and a conveyor device 24 for directing the flats towards sorting outlets 25 of the type having racks 26. The unstacker 22 is equipped with conveyor belts 27, with a movable paddle 28, and with blowers (not shown) as described in Patent Documents FR 2 797 856 and FR 06/53 270. The conveyor device 24 is a bin carrousel having bins 30 disposed in such a manner as to be inclined relative to the vertical. Inclined conveying makes it possible to improve the holding of the flats that tend to flop when they are conveyed on edge. The carrousel defines a closed-loop path along which the bins move above the sorting outlets 25 having racks 26. The flats conveyed in the bins of the bin carrousel 29 are thus dropped under gravity from the bins 30 towards the racks 26 merely by opening the bottoms of the bins.

Instead of a bin carrousel, it is possible to use some other conveyor of the belt type that moves the flats as laid flat. In which case, the conveyor is equipped with routing flaps for causing the flats to fall by gravity into racks placed under the conveyor.

Figure 2:
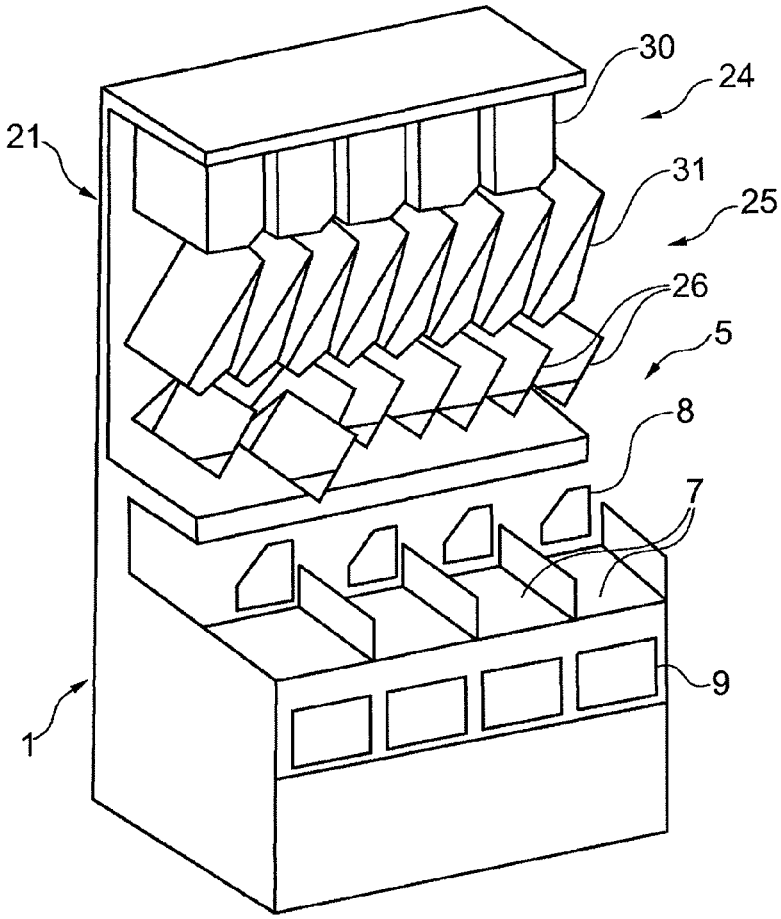
FIG. 2 is a more detailed view showing how the sorting outlet racks of the flats sorting machine and the stackers of the letters sorting machine are superposed.

As shown in FIG. 2, the rack sorting outlets of the sorting system 21 are superposed on (i.e. in vertical alignment with) respective ones of the stacker sorting outlets of the sorting system 1. There are thus as many rack sorting outlets as there are stacker sorting outlets and the sorting outlets are placed in register with one another so as to facilitate the manual work of merging the flats with the letters that is performed by the operator of the machine 20.

Figure 3:
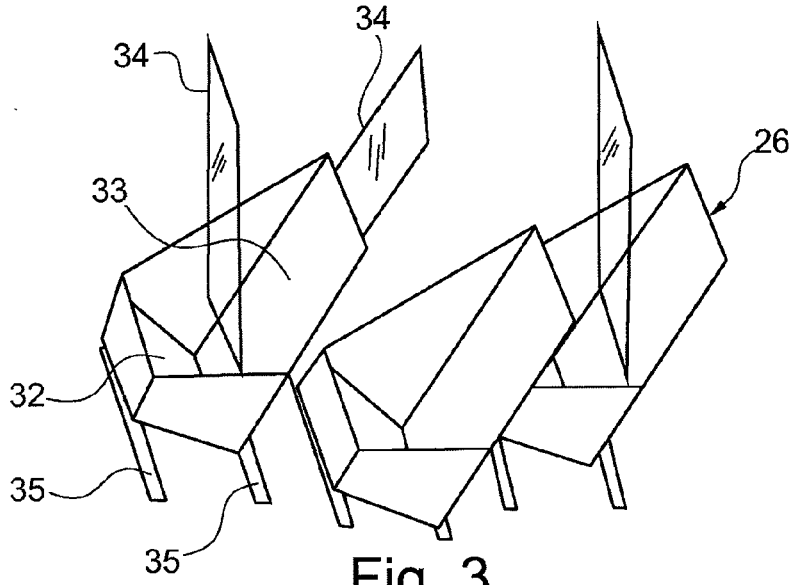
FIG. 3 is a more detailed view showing the shape of the sorting outlet racks.

FIG. 3 is a more detailed view showing the shape of the racks 26 of the flats sorting system. When a flat article leaves a bin, it slides down a guide ramp 31 that is inclined relative to the vertical and comes to jog against the bottom of the rack 26. Each rack 26 corresponds to a guide ramp 31. A rack 26 mainly comprises a jogging wall 32 for jogging the mailpieces into the bottom of the rack 26 and a mailpiece-receiving wall 33 for receiving the mailpieces. The jogging wall 32 and the mailpiece-receiving wall 33 form an angle of about 90° for storing the mailpieces. Each rack is placed in a position in which it is inclined relative to the vertical so that its mailpiece-receiving wall 33 lies in a plane that intersects the plane of the guide ramp 31 and that is arranged so as to enable quality stacking to be achieved in the bottom of the rack. The flat articles are thus guided, received flat against the mailpiece-receiving wall 33, and held in a stable stack by means of the jogging wall 32 for jogging the mailpiece into the bottom of each rack. In addition, a moving flap 34 mounted to pivot about a horizontal axis that extends perpendicularly to the conveying direction of the carrousel 24 exerts, by its weight, a bearing force against the stack of flats in the rack 26. The moving flap thus serves to maintain the flats in a stack in the rack 26. FIG. 3 also shows runners 35 on which the racks are mounted to move in translation along the same horizontal axis that extends perpendicularly to the conveying direction of the carrousel 24. As shown in FIG. 3, each rack can thus be moved between a retracted position vertically in register with the bins 30 for the purpose of receiving the mailpieces, this position being the configuration for the sorting process, and an extraction position in which the rack is brought above the corresponding stacker for the purpose of emptying the mailpieces away from the bin, this position being the configuration for the process of emptying the rack with a view to merging the mailpieces. When the rack 26 is in the retracted position, a space for giving access to the corresponding stacker is left vacant for the operator. This horizontal offset of the rack relative to the stacker in the depth direction makes it easy for the operator to access the mailpieces in the stacker.

In the invention, the stacker sorting system 1 and the rack sorting system 21 are arranged relative to each other so that their respective sorting outlets are put into register with one another. Each sorting outlet 25 of the rack sorting system 21 is superposed on (i.e. is aligned vertically with) a respective sorting outlet 5 of the stacker sorting system 1. Each sorting outlet 25 may comprise two sorting outlet racks 26 (or, where appropriate, more than two racks) and each sorting outlet 5 may comprise one stacker 7. For each sorting outlet 25, the two racks 26 may be juxtaposed relative to each other (i.e. disposed side-by-side in the horizontal direction) and superposed on a stacker 7 of a sorting outlet 5 corresponding to the sorting outlet 25. As shown in FIG. 2, the two juxtaposed racks of a sorting outlet 25 are dimensioned in such manner as to take up an amount of space in the width direction (conveying direction of the carrousel 24) that is substantially identical to the amount of space taken up by a stacker.

The sorting plan defines a logical correspondence between the two racks 26 and the corresponding stacker. In the method described in detail below for implementing the machine 1, the points of delivery assigned to a stacker are assigned in the same way to each of the two racks 26 associated with said stacker. With two racks per sorting outlet 25, it is possible to fill and to empty said two racks in alternation, thereby making it possible to increase very significantly the rate of processing of the mailpieces for performing the merging.

The sorting system 21 can be of the type having a conveyor for conveying the flats as laid flat so as to be suitable for processing an even wider spectrum of flats. With this type of conveying, it is possible to provide two racks at each sorting outlet 25, the two racks being superposed relative to each other and relative to a stacker of a corresponding sorting outlet 5. In this variant, the sorting outlets 5 are also aligned with the sorting outlets 25. It can be understood that each rack can have a width analogous to the width of a stacker.

A description follows of the process of merging the letters and the flats using the sorting machine of the invention in the context of preparing a delivery round in two sorting passes, which context is given by way of example.

Figure 4:
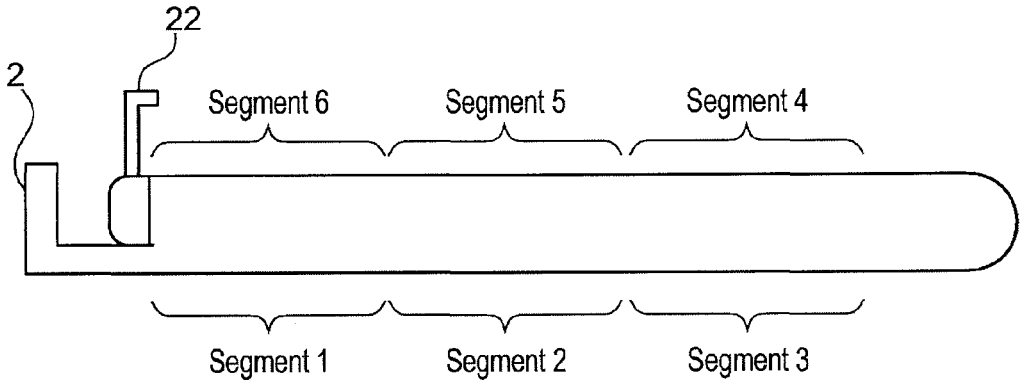
FIG. 4 is a view diagrammatically showing how the sorting outlets are arranged in segments in order to perform a second sorting pass (or a further, subsequent pass) for each segment, with the sorting machine of the invention.

The process starts by initializing the sorting systems 1 and 21 with the same sorting plan and by grouping together the sorting outlets into disjoint subsets of sorting outlets. For example, the sorting outlets are grouped together logically into a plurality of segments, e.g. six segments as shown in FIG. 4. Each segment groups together an equal number of adjacent sorting outlets, e.g. 50 sorting outlets per segment, i.e. a total of 300 sorting outlets. With 200 points of delivery being assigned to each sorting outlet, the sorting machine can sort a total of 60,000 points of delivery. In the implementation example, the segment 1 thus groups together 100 adjacent racks and the 50 corresponding stackers.

Figure 5:
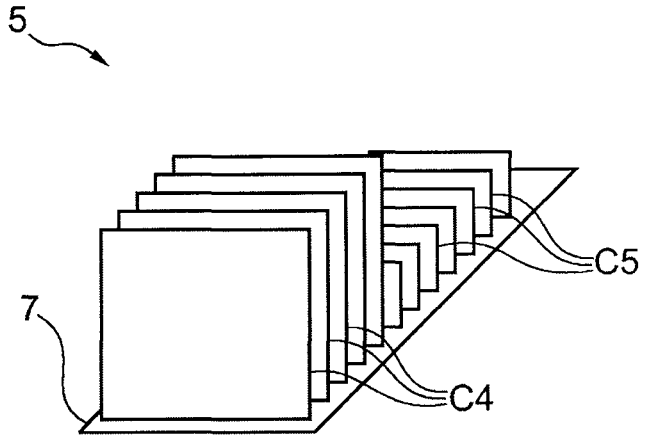
FIG. 5 is a view diagrammatically showing how various letters are stacked in an outlet stacker after the letters have been subjected to a first sorting pass.

During the first sorting pass, firstly the mailpieces (letters) that are of C4 format are fed into the unstacker 2 of the stacker sorting system 1 and are directed towards particular stackers 7 as a function of the points of delivery read from the letters. Then the letters that are of C5 format are fed into the unstacker 2 of the stacker sorting machine 1 and are directed towards particular stackers as a function of the points of delivery read from the letters. In the stacker 7, the letters of C4 format are thus grouped together in front of the letters of C5 format, as shown in FIG. 5.

In this example, it is considered that the letters are sorted first (before the flats) since the "letter" category of mailpieces generally represents about 80% of the volume of the mail to be processed. Therefore, the process for sorting the flats can start after the process for sorting the letters.

During the first sorting pass in the sorting system 21, the flats are therefore unstacked by the unstacker 22 and are directed towards one of the two racks 26 of the sorting outlet 25 to which the point of delivery read from the mailpiece is assigned. In this first sorting pass, the flats are directed towards only one of the two racks of a sorting outlet, the other rack of the sorting outlet not being used. If, for example, the sorting outlets 25 are juxtaposed racks, the flats can all be directed, for example, towards the left racks of the sorting outlets.

At the end of the first sorting pass, the operator empties the adjacent stackers one-by-one per segment depending on their position along the sorting machine 20. During this operation, the racks of the sorting outlets 25 are in a retracted position vertically in register with the bins 30. For each stacker, the operator places the mailpieces of C4 format flat in first storage strays and the mailpieces of C5 format on edge in second storage trays. These storage trays are then placed on a trolley mounted to move along the machine 20 or on a recirculation conveyor for the purpose of being brought to the unstacker 2 of the stacker sorting system 1 with a view to performing a new sorting pass. The recirculation order in which the trays are fed back into the inlet of the sorting system 1 is defined by the sorting plan.

At the end of the first sorting pass, the flats are also emptied from the racks. For this purpose, the operator pulls each rack towards said operator so as to bring it into vertical register with the corresponding stacker. As a result, the rack to be emptied thus becomes more accessible for being emptied. The operator then places the mailpieces from the rack flat in a storage tray that can be brought towards the unstacker 22 of the system 21 by means of the trolley that is mounted to move along the machine 20, or by means of a tray recirculation conveyor. The storage trays filled with flats at the inlet of the sorting system 21 are also in an order defined by the sorting plan.

In the example, the sorting outlets have thus been grouped together in six disjoint segments of sorting outlets. This grouping into segments takes place in the second sorting pass during which the letters and the flats are merged. It should thus be understood that in the sorting process, the second sorting pass is dissociated for the six different segments of sorting outlets. More particularly, it can be considered that, in the first sorting pass, six segments of sorting outlets (on each sorting system) have been used, with 50 sorting outlets per segment and 200 points of delivery per sorting outlet. In the second sorting pass, 200 sorting outlets of the machine are used, with 300 points of delivery per sorting outlet, for sorting 60,000 different points of delivery. However, since the processing in the second sorting pass is performed by using the grouping together into segments, only 300 points of delivery/6 segments are assigned, i.e. only 50 points of delivery are assigned per sorting outlet. Advantageously, each sorting outlet can successively contain the mailpieces belonging to the various segments 1, 2, etc. and, as described below, the mailpieces belonging to one segment are emptied and merged in parallel with the sorting of the mailpieces of the next segment. In addition, this arrangement avoids equipping the sorting machine with voluminous stackers that are large enough to accommodate mailpieces corresponding to 300 points of delivery, and thereby improves the overall compactness of the sorting machine.

During the second sorting pass, the storage trays from the segment 1 are processed before the storage trays from the segment 2. Prior to feeding in the storage trays from the segment 1, the operator indicates to the management unit of the machine 20 that the trays from the segment 1 are going to be fed in. For example, the operator pushes a button corresponding to the segment 1 at the power supply inlet.

In order to optimize the processing rate, the storage trays are fed simultaneously both into the unstacker 2 and into the unstacker 22. Thus, the processing of the mailpieces (letters) of C4 format and of C5 format is performed on the stacker sorting system 1 in parallel with the sorting of the flats on the rack sorting system 21.

In the same way as in the first sorting pass, the letters of C4 format are fed into the stacker 2 before the letters of C5 format.

Figure 6:
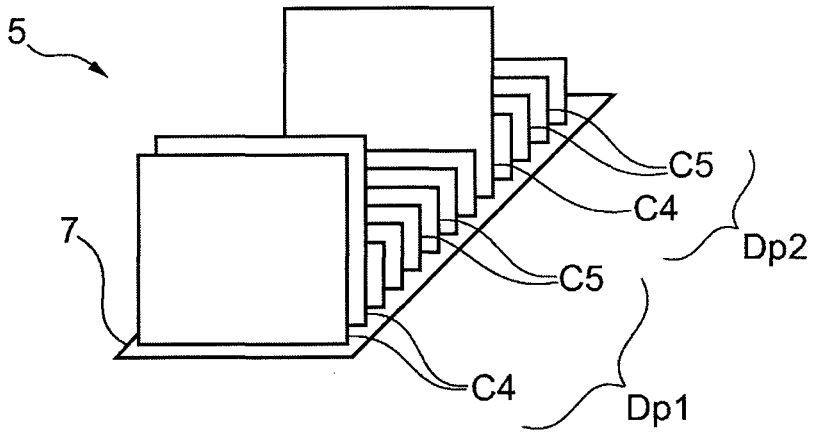
FIG. 6 is a view diagrammatically showing how various letters are stacked in an outlet stacker after the letters have been subjected to a second sorting pass.

At the end of this second sorting pass for the segment 1, the mailpieces of the C4 and C5 formats are placed in sequence in the stackers or in the racks in the same order as the delivery round. As shown in FIG. 6, the mailpieces are thus grouped together in sequence per point of delivery, with the letters of C4 format placed in front of the letters of C5 format for each point of delivery. In the example of the stacker shown in FIG. 6, the mailpieces having the point of delivery DP1 thus find themselves in front of the mailpieces whose point of delivery is DP2, the point of delivery DP1 preceding DP2 in the delivery round. In addition, among the mailpieces having the point of delivery DP1, the letters of C4 format find themselves in front of the letters of C5 format. The mailpieces of C4 format thus act as separator cards or as visible identifiers for identifying the change of delivery point in the delivery round.

With the operator having indicated the processing of the segment 1 to the machine, the flats belonging to the segment 1 are, for example, directed by the management unit to the first of the two racks of each sorting outlet. At the end of said second sorting pass for the segment 1, the flats are disposed in sequence for the delivery round in the first rack of each sorting outlet.

The second sorting pass of the segment 2 is implemented in a manner similar to the manner described above with reference to the second sorting pass of the segment 1. In particular, the operator indicates to the management unit of the machine 20 that the trays of the segment 2 are going to be fed in. The operator then feeds in the storage trays of the segment 2 as described above.

In a stacker, the mailpieces of the segment 2 can be stacked while the mailpieces of the segment 1 are still present. For example, a separator card can have been provided in the sorting process for the purpose of separating, in the same stacker, the mailpieces belonging to the segment 1 from the mailpieces belonging to the segment 2.

Unlike the processing of the segment 1, the management unit of the sorting machine 20 directs the flats belonging to the segment 2 towards the second of the two racks of each sorting outlet. As a result, for the same sorting outlet, the flats belonging to the segment 2 are directed towards the second rack while flats belonging to the segment 1 are still present in the first rack.

During the second sorting pass of the segment 3, the management system directs the flats towards the first of the two racks of each sorting outlet and so on for the six segments.

It can be understood that, during the second sorting pass, for processing a particular segment, the flats are directed towards the rack that is not occupied by the processing of the following segment or of the preceding segment. In other words, for processing each new segment, the management system alternates the rack of the sorting outlet towards which the flats are directed. Advantageously, the mailpieces of a segment contained in a rack of a sorting outlet are then extracted and merged while mailpieces of another segment are sorted in the other rack of the same sorting outlet.

For implementing the emptying process, the operator firstly extracts the mailpieces of C4 format and of C5 format that belong to the segment 1 from a stacker. In particular, the operator identifies the mailpieces belonging to the segment 1 by means of the separator card, said operator raises and moves the movable paddle 8 to the separator card, and extracts the mailpieces belonging to the segment 1. These operations are performed while the mailpieces belonging to the segment 2 continue to stack up in the stacker.

The mailpieces of the segment 1 that are extracted from the stacker are then merged with the flats of the same segment 1. For this purpose, the operator identifies the rack that corresponds to the segment 1 (the rack that is already filled and not the rack that is being filled) and the operator moves the rack from the position in vertical register with the bins of the carrousel to an extraction position described with reference to FIG. 3. In the invention, the other rack of the same outlet is still in vertical register with the bins for the purpose of receiving the flats belonging to the segment 2. The operator extracts the flats and inserts them into the stack of mailpieces extracted from the stacker. Each flat is inserted manually into the stack by reading its point of delivery that it bears, and by identifying the point of delivery in the stack of mailpieces extracted from the stacker by means of the mailpieces of the C4 format that acts as separator cards.

Figure 7:
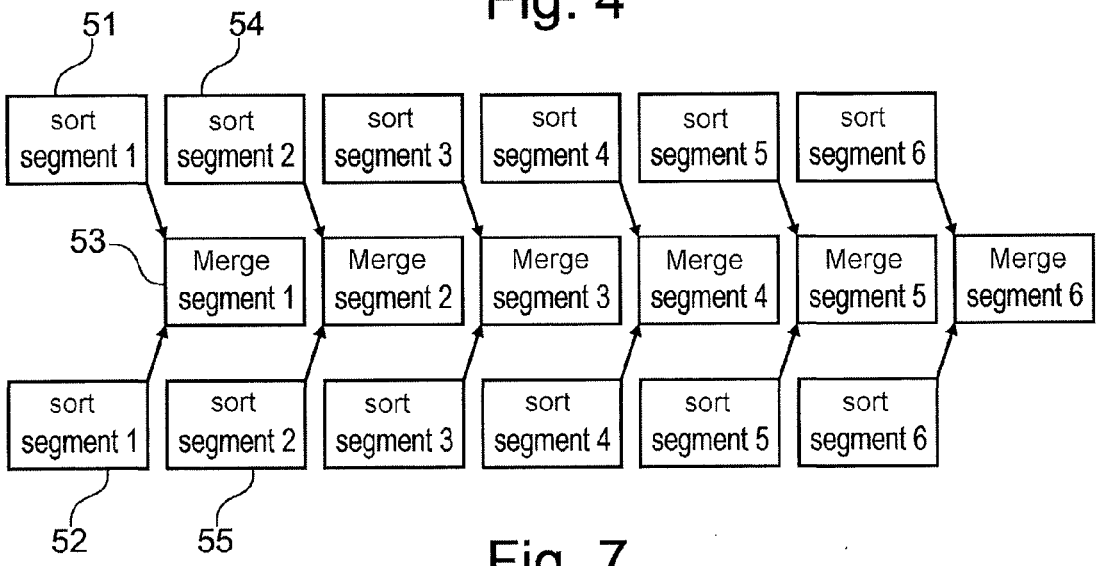
FIG. 7 is a block diagram showing the various steps of merging the flats with the letters that takes account of a segmentation of the sorting outlets.

Therefore, in the invention, the sorting 51 of the flats is performed in parallel with the sorting 52 of the letters of the C5 and of the C4 formats for the segment 1 as shown in FIG. 7. In addition, the process of merging for the segment 1, in which process the various types of mailpiece are merged 53 (actually the flats are inserted into a stack of letters of C5 format or of C4 format) in order to form the delivery round is also performed in parallel with the sorting processes 54 and 55 for sorting the flats and the letters of the C5 and C4 formats for the segment 2. Then, the same procedure is used for the following segments. This process whereby the sorting outlets are processed per segment contributes to increasing the operational throughput rate of the sorting machine considerably.

It should be noted that a sorting pass prior to the first sorting pass may be implemented for outward sorting. In this prior sorting pass, the mailpieces are sorted as a function of the post code appearing on the mailpiece in order to direct the mailpieces towards other sorting centers in which two-pass sorting is performed.

When the mailpieces are conveyed flat with routing flaps being used, the fact that the two racks of any one sorting outlet are superposed also makes it possible to increase the operational rate of processing of the mailpieces. If the number of sorting outlets is sufficient, the flats can be sorted per segment during the outward sorting pass. In this particular embodiment, at the end of the second sorting pass for the segment 1, the sorted flats in the upper rack of a sorting outlet are directed towards the lower rack of said sorting outlet. The flats in the lower rack can thus be extracted and merged while the flats of the segment 2 are being sorted into the upper rack of the sorting outlet.

In a particular embodiment, the first sorting pass of the flats can be omitted. In which case, each of the flats finds itself placed in the rack corresponding to its point of delivery but the order of the flats in each rack does not correspond to the sequence defined for the delivery round. Since the number of flats to be processed is small compared with the number of the other mailpieces, the fact that they are not put into sequence does not significantly affect the rate of processing. In any event, the points of delivery of the flats are read by the operator before said flats are inserted into the stack extracted from the stacker. In this way, even if the flats are not in sequence, the operator nevertheless places the flat in its position in the delivery round.

It can be understood that, in using this sorting machine, the sorting system 1 adapted conventionally for letters of C5 format is intended also for processing mailpieces of C4 format in order to sort most of the mail in this sorting system that has stacker sorting outlets. The sorting system 21 adapted for flats that conventionally do not exceed 2 kg may also be intended for sorting flats exceeding 2 kg so as to obtain a compact sorting machine that is adapted to accommodate a broad spectrum of mixed mail.

The invention claimed is:

1. A sorting machine for sorting mailpieces including both letters and flats, is characterized in that it comprises:

a first sorting system (21) adapted for flats and including a first mailpiece conveyor (24) arranged above first sorting outlets (25) of said first sorting system (21), said first mailpiece conveyor (24) being suitable for directing the flats towards said first sorting outlets (25) of the type having racks (26) into which the flats fall by gravity; and a second sorting system (1) adapted for letters and including a second mailpiece conveyor suitable for directing the letters towards second sorting outlets (5) of the type having stackers (7) in which the letters are stacked on edge one behind another;

and in that said first and second sorting systems (21, 1) are in superposition such that said second sorting system (1) is disposed under said first sorting system (21), said first and second sorting systems (21, 1) have the same number of sorting outlets (25, 5), said first and second sorting systems (21, 1) being superposed so that the first sorting outlets (25) of the first sorting system (21) are superposed on respective ones of the second sorting outlets (5) of the second sorting system (1) so as for said sorting outlets (25) to be vertically aligned with said sorting outlets (5), and in that said racks (26) of the first sorting outlets (25) of the first sorting system (21) for sorting the flats being offset depthwise relative to said stackers (7) of said second sorting outlets (5) of said second sorting system (1), said first sorting system (21) further comprising runners (35) on which the racks (26) are mounted to move in translation along a horizontal axis that extends perpendicularly to the conveying direction of said first mailpiece conveyor (24), each rack (26) being able to be moved between a retracted position in which said rack (26) is in vertical register with said first mailpiece conveyor (24) for the purpose of receiving the flats and an extraction position in which said rack (26) is brought above and in vertical register with the corresponding stacker (7) for the purpose of emptying said rack (26), said rack (26) being arranged in its retracted position to leave a space for giving access to the corresponding stacker (7).

2. A sorting machine according to claim 1, wherein each sorting outlet of the first system is equipped with at least two racks towards each of which a flat can be directed selectively by the first conveyor.

3. A sorting machine according to claim 2, wherein said at least two racks of a sorting outlet of the first sorting system are juxtaposed, and wherein the conveyor of the first sorting system is a bin carrousel.

4. A sorting machine according to claim 2, wherein said at least two racks of a sorting outlet of the first sorting system are superposed, and wherein the conveyor of the first sorting system is a belt conveyor on which the flats are moved as laid flat.

5. A method of sorting mailpieces including both letters and flats, in a sorting machine said method comprising:

providing a first sorting system (21) adapted for flats and including a first mailpiece conveyor (24) arranged above first sorting outlets (25) of said first sorting system (21), said first mailpiece conveyor (24) being suitable for directing the flats towards said first sorting outlets (25) of the type having racks (26) into which the flats fall by gravity; and a second sorting system (1) adapted for letters and including a second mailpiece conveyor suitable for directing the letters towards second sorting outlets (5) of the type having stackers (7) in which the letters are stacked on edge one behind another;

and in that said first and second sorting systems (21, 1) are in superposition such that said second sorting system (1) is disposed under said first sorting system (21), said first and second sorting systems (21, 1) have the same number of sorting outlets (25, 5), said first and second sorting systems (21, 1) being superposed so that the first sorting outlets (25) of the first sorting system (21) are superposed on respective ones of the second sorting outlets (5) of the second sorting system (1) so as for said sorting outlets (25) to be vertically aligned with said sorting outlets (5), and in that said racks (26) of the first sorting outlets (25) of the first sorting system (21) for sorting the flats being offset depthwise relative to said stackers (7) of said second sorting outlets (5) of said second sorting system (1), said first sorting system (21) further comprising runners (35) on which the racks (26) are mounted to move in translation along a horizontal axis that extends perpendicularly to the conveying direction of said first mailpiece conveyor (24), each rack (26) being able to be moved between a retracted position in which said rack (26) is in vertical register with said first mailpiece conveyor (24) for the purpose of receiving the flats and an extraction position in which said rack (26) is brought above and in vertical register with the corresponding stacker (7) for the purpose of emptying said rack (26), said rack (26) being arranged in its retracted position to leave a space for giving access to the corresponding stacker (7)

said method comprising the steps of:

passing said letters through said second sorting system for automatically sorting them into the sorting outlet stackers;

passing said flats through said first sorting system for automatically sorting them and load them by gravity into the sorting outlet racks in their retracted position;

moving one or more racks from the retracted position to the extraction position above corresponding stackers, merging one or more flats stored in each sorting outlet rack of the first sorting system moved to the extraction position manually with the letter(s) stored in the sorting outlet stacker of said second sorting system that is disposed in superposition with and below said sorting outlet rack in the extraction position.

6. A method according to claim 5, further comprising using the sorting outlets by grouping them together into a plurality of disjoint segments, and using in alternation two racks of each sorting outlet of the first sorting system for merging the flats with the letters.

7. A method according to claim 6, further comprising separating by a separator card, in the same stacker, the letters that belong to different sorting outlet segments.

* * * * *